US005910712A

United States Patent [19]

Toyama

[11] Patent Number: 5,910,712

[45] Date of Patent: Jun. 8, 1999

[54] METHOD AND APPARATUS FOR REDUCED DISCHARGE LAMP DRIVER TEST TIME

[75] Inventor: Koichi Toyama, Kariya, Japan

[73] Assignee: Denso Corporation, Kariya, Japan

[21] Appl. No.: 08/933,514

[22] Filed: Sep. 18, 1997

[30] Foreign Application Priority Data

Oct. 14, 1996 [JP] Japan ..... 8-271013

[51] Int. Cl.[6] ..... H05B 37/02

[52] U.S. Cl. ..... 315/307; 315/363; 315/360; 315/224; 315/225; 324/500

[58] Field of Search ..... 315/307, 363, 315/360, 224, 225; 324/500, 555, 556

[56] References Cited

U.S. PATENT DOCUMENTS 5,241,242 8/1993 Daub ..... 315/289

5,317,237 5/1994 Allison et al. ..... 315/307

FOREIGN PATENT DOCUMENTS

A-2-51895 2/1990 Japan .

A-5-251189 9/1993 Japan .

*Primary Examiner*—Benny Lee

*Assistant Examiner*—Michael B Shingleton

*Attorney, Agent, or Firm*—Nixon & Vanderhye P.C.

[57] ABSTRACT

A discharge lamp driver is configured so that it can be operationally tested using a substitute impedance instead of a discharge lamp. The time required to functionally test the driver circuit with such a substituted non-discharge lamp load is considerably less than if an actual discharge lamp is used for such testing.

8 Claims, 3 Drawing Sheets

METHOD AND APPARATUS FOR REDUCED DISCHARGE LAMP DRIVER TEST TIME

CROSS REFERENCE TO RELATED APPLICATION

The present application is based on and claims priority from Japanese Patent Application No. Hei 8-271013, filed on Oct. 14, 1996, the contents of which are incorporated herein by reference.

BACKGROUND OF THE INVENTION

1. Field of the Invention

The present invention relates to a discharge lamp (e.g. a metal halide lamp for a vehicle head lamp) driving device and method.

2. Description of the Related Art

Discharge lamps used for a vehicle head lamp are required to become stable as soon as turned on. In order to meet the requirement, a high pulse voltage typically is applied to the discharge lamp when it is turned on providing higher than regular power to raise lamp electrode temperature the until it becomes stable. Thereafter, the input power to the lamp is gradually reduced to regular operating power.

Usually, a time constant circuit composed of a capacitor and a resistor is used for gradually reducing initial turn-on power to regular operating power. If the regular power of the discharging lamp is 35 watts (W), the time constant of the time constant circuit is usually 6–8 seconds and the time required for the discharge lamp to become stable after it is turned on is about 30–40 seconds.

Therefore, such a long required turn-on time becomes a big problem when many drivers for discharge lamps are manufactured and tested.

SUMMARY OF THE INVENTION

The present invention has a main object of providing an improved discharge lamp driver which considerably reduces the time necessary for testing its operation.

According to a main feature of the present invention, a discharge lamp driving device comprises first means for supplying an outside load with power that is higher than normal power from the beginning and which becomes stable in a stabilizing period, and second means for shortening the stabilizing period when the outside load is detected as a specific (i.e. predetermined) non-discharge lamp load. The specific outside load may be a dummy resistor used for testing the driver operation. The dummy resistor makes the driver test work easy.

According to another feature of the present invention, the discharge lamp driving device may additionally include third means for detecting voltage applied to the dummy resistor. When the detected voltage is not higher than a predetermined voltage, the device recognizes connection of the dummy resistor instead of the discharge lamp. For this purpose, the third means may comprise a circuit for judging the outside load to be the dummy resistor when the voltage applied to the outside load becomes a predetermined voltage in a predetermined period after the outside load is supplied with power. The third means may comprise a time constant circuit for providing the predetermined period and the second means may comprise a circuit for changing the stabilizing period when the outside load is the dummy resistor.

In addition, the time constant circuit may comprise a first series circuit of a capacitor and a first resistor, the circuit for changing stabilizing period comprises a second series circuit of a second resistor which has a resistance smaller than that of the first resistor and a switch member, the second series circuit is connected in parallel with the first resistor, and the switch member connects the second resistor when the power is supplied to the dummy resistor.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
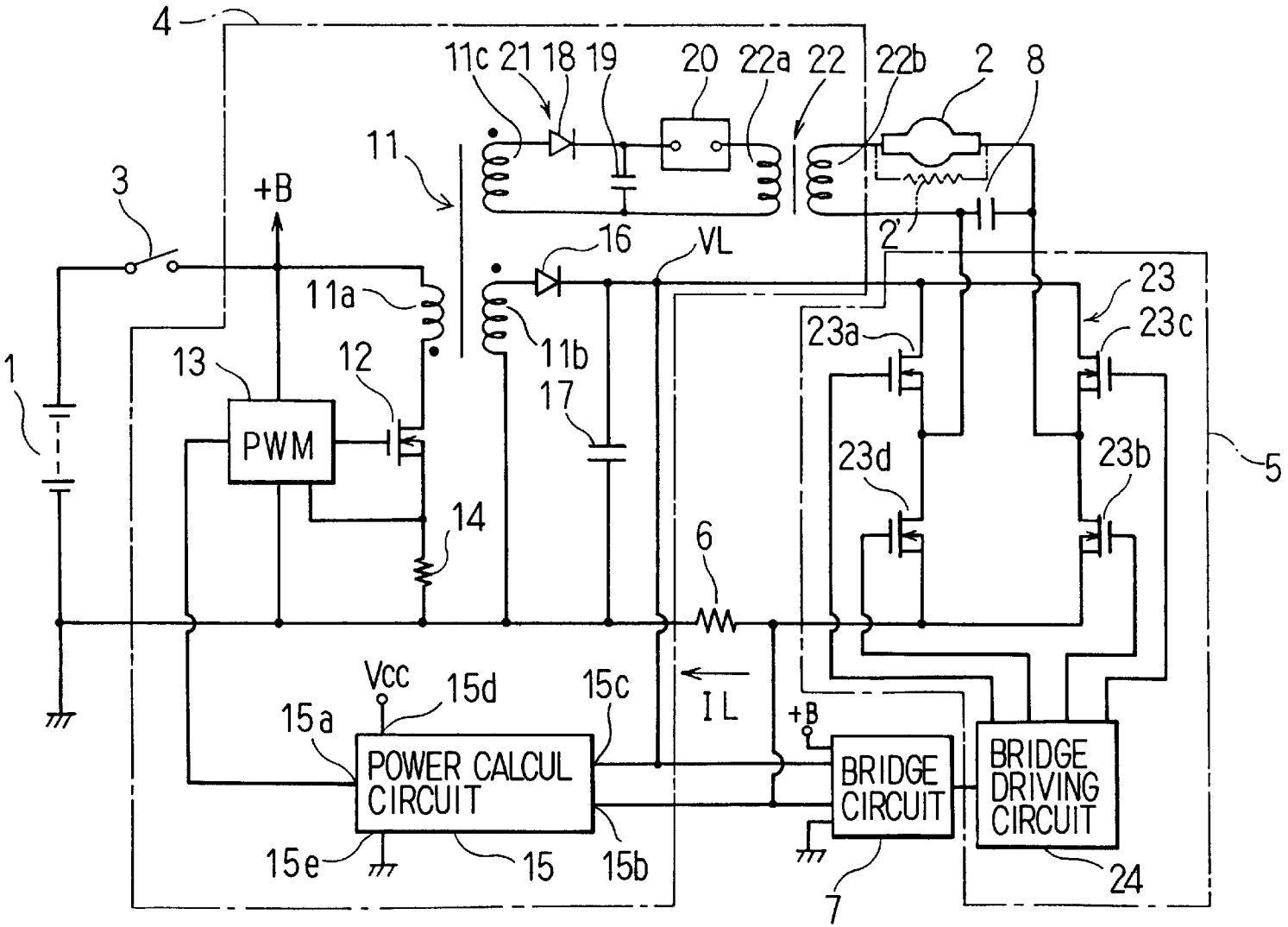
FIG. 1 is a circuit diagram of a discharge lamp driving device according to an embodiment of the present invention.

In FIG. 1, a reference numeral 1 indicates a battery. A discharge lamp 2 and a lamp switch 3 are connected to a dc-power circuit 4. The power circuit 4 has a flyback transformer 11, which is composed of a primary coil 11*a* connected to the battery 1 and a pair of secondary coils 11*b*, 11*c*. A reference numeral 5 denotes an inverter, a reference numeral 6 denotes a current detecting resistor, a reference numeral 7 is a bridge control circuit, and a reference numeral 8 is a capacitor for protecting a H-shape bridge circuit 23 from high tension voltage. The primary current of the flyback transformer 11 is controlled by a power MOS transistor 12, which is controlled by a PWM (pulse width modulation) circuit 13. The PWM circuit 13 detects the primary current by a resistor 14 and controls the power MOS transistor 12, thereby controlling the primary current to equal a set value. A power calculation circuit 15 determines electric power to be supplied to the discharge lamp 2 according to lamp voltage VL and lamp current IL and terminal voltage Vc of a capacitor 114 shown in FIG. 2 and sends a power command signal to the PWM circuit 13. The power calculation circuit 15 provides the PWM circuit 13 with a command signal to supply a comparatively high power to the discharge lamp 2 just after it is turned on and a command signal to gradually reduce the power supplied to the same.

A series circuit of a diode 16 and a capacitor 17 is connected in parallel with one of the secondary coils 11*b* of the flyback transformer 11 to rectify and smooth the alternating current generated by the coil 11*b*, which is supplied to the H-shape bridge circuit 23 of the inverter 5. In a starting circuit 21, a series circuit of a diode 18 and a capacitor 19 is connected in parallel with the other secondary coil 11*c* to rectify and smooth the alternating current generated by the coil 11*c*, and a series circuit of discharge gap member 20 and a primary coil 22*a* of a high tension transformer 22 is connected in parallel with the capacitor 19. The gap member 20 allows the capacitor 16 to discharge therethrough when the terminal voltage of the capacitor 19 becomes higher than a preset voltage. When the capacitor 19 discharges through the gap member 20, a high tension voltage is generated by the secondary coil 22*b* of the transformer 22.

The H-shape bridge circuit 23 is composed of four power MOS transistors 23*a*, 23*b*, 23*c*, 23*d* and a bridge-driving circuit 24, which turns on or off a pair of transistors 23*a* and 23*b* and a pair of transistors 23*c* and 23*d* alternately.

Figure 2:
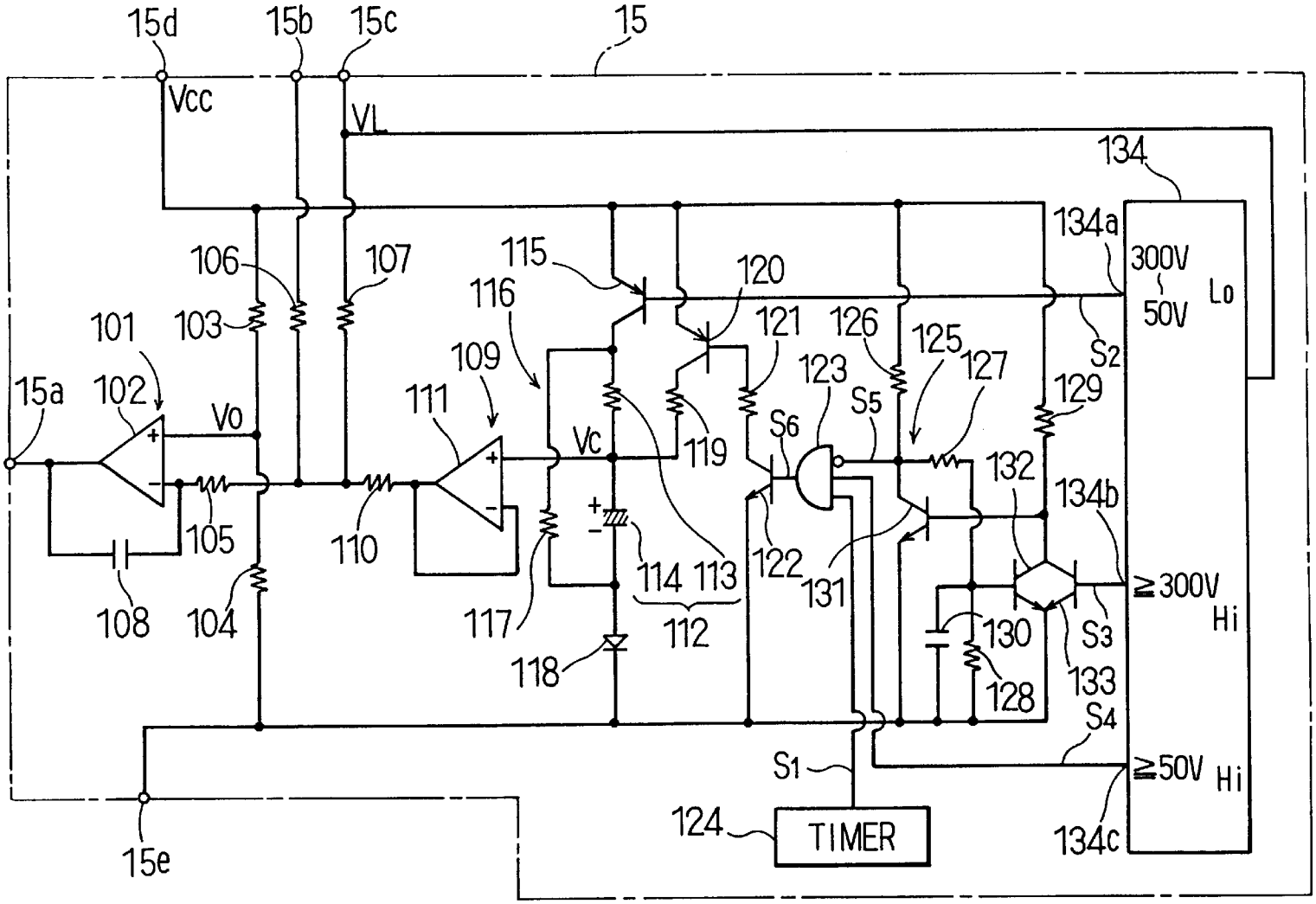
FIG. 2 is a circuit diagram of a calculation circuit of power of the device shown in FIG. 1.

In FIG. 2, a reference numeral 101 denotes a deviation amplifying circuit which is composed of an operational amplifier 102, which has an output terminal 15*a*, a non-inverting input terminal and an inverting input terminal. The output terminal 15*a* of the operational amplifier is connected to the PWM circuit 13, the non-inverting input terminal thereof is connected to a junction of series connected resistors 103 and 104, and the inverting input terminal is connected to a lamp current detecting terminal 15*b* through resistors 105 and 106, to a lamp voltage detecting terminal 15*c* through resistors 105, 107, and also to an output terminal of another operational amplifier 111 through resistors 105 and 110. The series circuit of the resistors 103 and 104 divides a voltage Vcc applied across terminals 15*d* and 15*e* and provides a reference voltage Vo at the junctions. A capacitor 108 is connected between the output terminal 15*a* of the operational amplifier 102 and the inverting input terminal thereof to prevent abnormal oscillation. Thus, the deviation amplifying circuit 101 amplifies a difference between the reference voltage Vo and a sum of a voltage proportional to the lamp current IL at the terminal 15*b*, a voltage proportional to the lamp voltage VL at the terminal 15*c* and the output voltage of the operational amplifier 111.

The operational amplifier 111 has a feedback circuit connected between the output terminal thereof and the inverting input terminal thereof and forms a voltage follower 109. The operational amplifier 111 has a non-inverting input terminal 119 connected to the plus terminal of capacitor 114, which forms a time constant circuit 112 together with a resistor 113. The resistor 113 is connected to the collector of a switching transistor 115. The base of the transistor 115 is connected to an output terminal 134*a* of a lamp voltage detecting circuit 134, which detects normal starting of the lamp operation according to the lamp voltage VL. The lamp voltage detecting circuit 134 provides signals S2, S3, S4 according to levels of the lamp voltage. When the lamp voltage VL is a level between a low level VLo (e.g. 50 volts) and a high level VHi (e.g. 300 volts), the signal S2 of an output terminal 134*a* is low; when the lamp voltage VL is a level higher than VHi, the signal S3 of an output terminal 134*b* is high; and when the lamp voltage VL is a level higher than VLo, the signal S4 of an output terminal 134*c* is high. A diode 118 is connected between the minus terminal of the capacitor 114 and a ground to prevent current from flowing to the plus side when the capacitor 114 discharges. A resistor 117 is connected in parallel with the time constant circuit 112 composed of the resistor 113 and the capacitor 114 to form a discharge circuit 116. A series circuit of a resistor 119 whose resistance is lower than that of the resistor 113 of the time constant circuit 112, and a switching transistor 120 is connected in parallel with the series circuit of the resistor 113 and the transistor 115. The base of the transistor 120 is connected to the collector of a transistor 122 through a resistor 121. The base of the transistor 122 is connected to an output terminal of an AND circuit 123 which has three input terminals one of which is connected to a timer 124 to receive a signal S1 therefrom. The timer 124 switches the output signal S1 thereof to the high level 0.5 second after the lamp switch 3 is turned on. One of the three input terminals of the AND circuit 123 is an inverting terminal connected to the collector of a transistor 131, so that a signal S5 from the transistor 131 is inverted when it is applied to the AND circuit 123. The remaining input terminal is connected to the terminal 134*c* of the lamp voltage detecting circuit 134 to receive a signal S4 therefrom.

A flip-flop circuit 125 is composed of resistors 126, 127, 128 and 129, a capacitor 130, the transistor 131 and a transistor 132. When a constant voltage Vcc is applied on the terminal 15*d*, the transistor 131 is turned on and the transistor 132 is turned off because of the capacitor 130. A transistor 133 is connected in parallel with the transistor 132 of the flip-flop circuit 127. Accordingly, when the terminal 134*b* of the lamp voltage detecting circuit 134 provides the signal S3 in the high level, the transistor 133 is turned on to turn off the transistor 131.

Figure 3B:
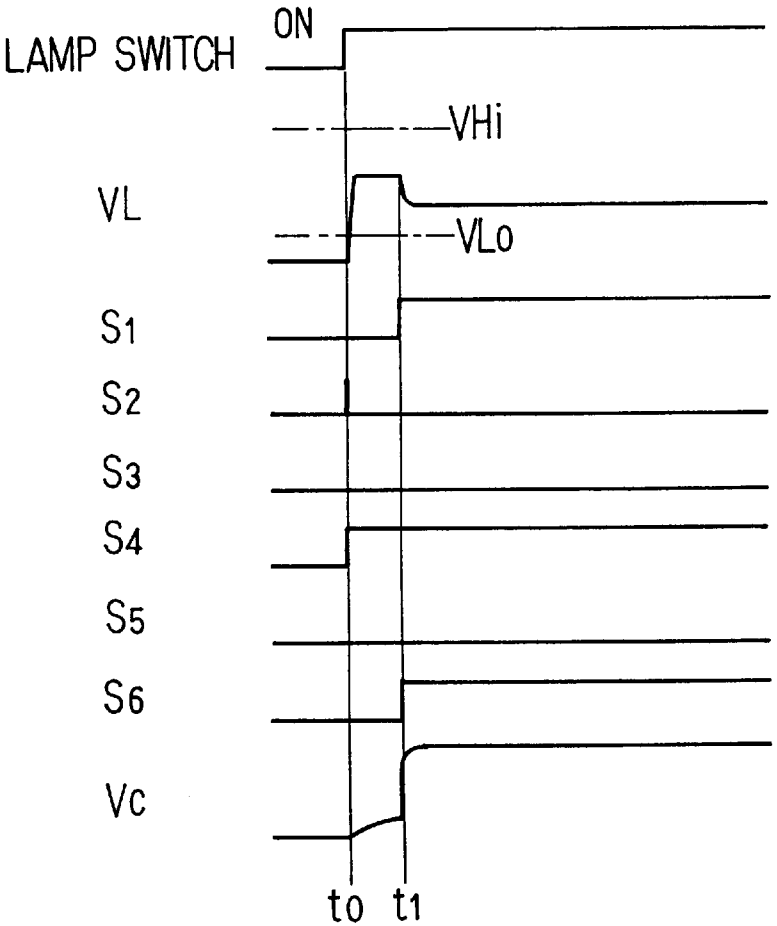
FIG. 3A and FIG. 3B are timing charts showing operation of the calculation circuit shown in FIG. 2.
Figure 3A:
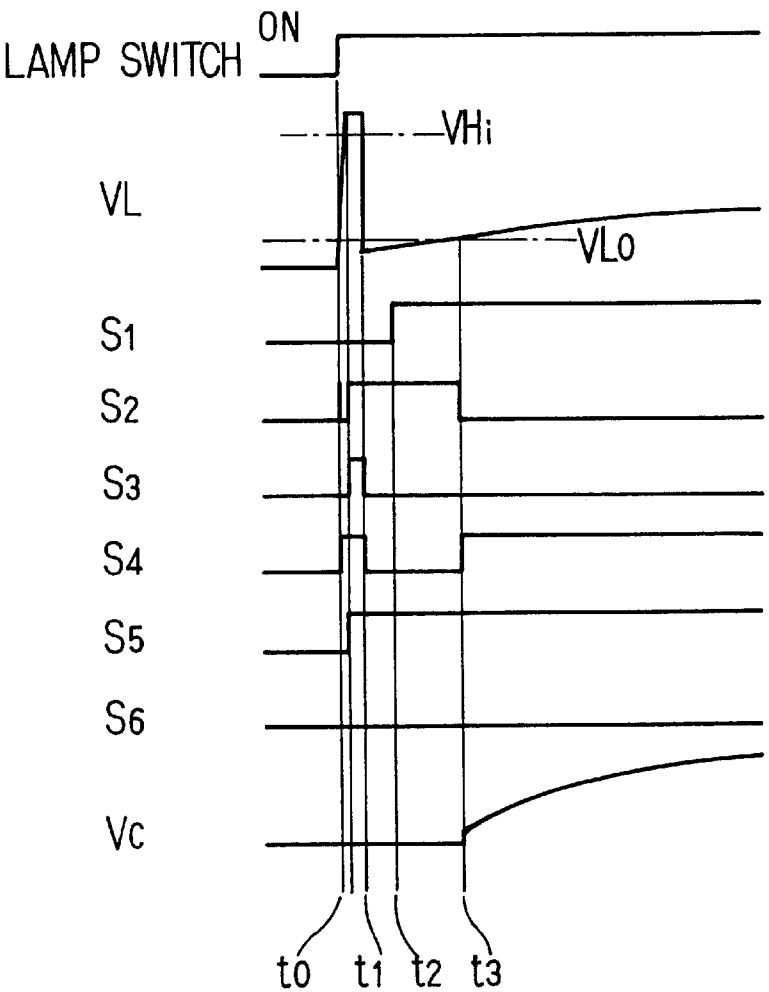

Operation of the discharge lamp 2 is described with reference to FIGS. 3A and 3B.

1) Period between t0 and t1

The lamp switch 3 is turned on at a time t0, when the capacitor 114 is not charged, to start operation of the dc-power circuit 4. Subsequently, the capacitor 17 is charged so that the terminal voltage VL thereof becomes about 400 volts, which is applied to the inverter 5. The voltage VL is also applied to the lamp voltage detecting circuit 134 to provide high level signals S2, S3, S4 as shown in FIG. 3A. Thus, the transistor 115 is turned off to cut a passage from the terminal 15*d* through the resistor 113 to the capacitor 114, and the transistor 133 is turned on, thereby turning off the transistor 131 and turning on the transistor 132. Since the output signal S5 of the flip-flop circuit 125 becomes high and the signal S1 of the timer 124 is low, the output signal S6 of the AND circuit 123 remains low as shown in FIG. 3A. As a results the transistors 122 and 120 are turned off to keep the capacitor 114 from a passage to the terminal 15*d* through the resistor 119.

2) Period between t1 and t2

When a high tension pulse voltage (lamp voltage VL) is applied to the discharge lamp 2, the discharge lamp 2 starts discharging at time t1, and the lamp voltage VL lowers to a voltage lower than 50 volts. The output signal S2 of the lamp detecting circuit 134 remains high so that the transistor 115 remains turned off. Although the output signal S3 becomes low, the transistor 132 remains turned on so that the transistor 131 remains turned off and the output signal S5 of the flip-flop circuit 125 remains high. The output signal S4 becomes low and, consequently, the output signal S6 of the AND circuit 123 remains low and the transistors 122 and 120 remain turned off, thereby keeping the capacitor 114 from the terminal 15*d* through the resistor 119.

3) Period between t2 and t3

At a time t2 which is 0.5 seconds after the time t0, the output signal S1 of the timer 124 becomes high. However, the output signal S5 of the flip-flop circuit 125 remains high and the output signal S4 of the lamp detecting circuit 134 remains low, and the output signal S6 of the AND circuit 123 remains low to keep the capacitor 114 from the passage from the terminal 15*d* through the resistor 119.

4) After time t3

The lamp voltage VL gradually increases as the temperature of the lamp increases. When the lamp voltage VL becomes 50 volts at time t3, the output signal S2 of the lamp detecting circuit 134 becomes low to turn on the transistor 115, thereby connecting the capacitor 114 to the terminal 15*d* through the resistor 113. Although the output signal S4 of the lamp detecting circuit 134 becomes highs the output signal S5 of the flip-flop circuit 125 still remains high so that the output signal of the AND circuit S6 remains low, thereby keeping the capacitor 114 from the passage to the terminal 15*d* through the resistor 119. As a results the capacitor 114 is charged through the resistor 113, which has a comparatively high resistance, so that the terminal voltage Vc of the capacitor is gradually raised and finally saturated with the terminal voltage Vcc to be stable.

During the period between t0 and t3, the output voltage of the operational amplifier 111 is so low that the lamp voltage signal applied through the resistor 107 and the lamp current signal applied though the resistor 106 are absorbed by the amplifier 111. Accordingly, the deviation amplifying circuit 101 sends the PWM circuit 13 a command signal to provide the discharge lamp with a high power such as 70 watts. Thus, high power is supplied to the discharge lamp 2 to increase the electrode temperature in a short time.

After the time t3, the output voltage of the operational amplifier 111 gradually increases, and the deviation amplifying circuit 101 sends the PWM circuit 13 a command signal to provide the discharge lamp 2 with power which gradually decreases from 70 watts to 30 watts (normal power).

When the driving device is tested for shipment, a dummy resistor 2' shown in FIG. 1 is substituted for the discharge lamp 2. The operation of the device in the test is described with reference to FIG. 3B.

1') Period between t0 and t1

The lamp switch 3 is turned on at a time t0 when the capacitor 114 is not charged to start operation of the dc-power circuit 4. Subsequently, the capacitor 17 is charged so that the terminal voltage VL thereof increases and is applied to the inverter 5. Consequently, current flows to the dummy resistor 2' through the power MOS transistors 23*a*, 23*b*, 23*c* and 23*d*. The voltage VL does not increase as high as 300 volts. Accordingly, the output signal S2 of the lamp voltage detecting circuit 134 becomes low, and the transistor 115 is turned on to connect the capacitor 114 to the terminal 15*d* through the resistor 113. The output signal S3 of the lamp voltage detecting circuit 134 is low, and the output signal of the flip-flop circuit 125 is low. The output signal S4 of the lamp voltage detecting circuit 134 is highs and the output signal S1 of the timer 124 is low. Accordingly, the output signal S6 of the AND circuit 123 is low, and the transistors 122 and 120 are turned off to keep the capacitor 114 from the passage to the terminal 15*d* through the resistor 119. As a results the capacitor 114 is charged through the resistor 113 gradually for a comparatively long period decided by the capacitance of the capacitor 114 and the resistance of the resistor 113.

2') Period after t1

At a time t1 which is 0.5 seconds after the time t0, the output signal S1 of the timer 124 becomes high, and the output signal S6 of the AND circuit 123 becomes high to turn on the transistors 122 and 120, thereby charging the capacitor 114 through the resistor 119, which has comparatively low resistance. As a result, the terminal voltage Vc of the capacitor 114 increases to the voltage Vcc of the terminal 15*d* in a short time.

During the period between t0 and t1, the output voltage of the operational amplifier 111 is so low that the lamp voltage signal applied through the resistor 107 and the lamp current signal applied though the resistor 106 are absorbed by the amplifier 111. Accordingly, the deviation amplifying circuit 101 sends the PWM circuit 13 a command signal to provide the discharge lamp with a high power. Thus, high power is supplied to the dummy resistor 2'.

Because the output voltage of the operational amplifier increases to the terminal voltage Vcc in a short time, the lamp voltage signal and the lamp current signal are added to the inverting input terminal 105 so that the deviation amplifying circuit 101 sends the PWM circuit 13 a command signal to gradually decrease the power supplied to the dummy resistor 2' to 30 watts.

Thus, if the lamp voltage VL does not increase to a preset level VHi, it is considered that the discharge lamp 2 is replaced with the dummy resistor 2', and, subsequently, the input power is supplied to the lamp in a short time so that the test or adjustment before shipment can be made in a short time.

A signal other than the lamp voltage VL can be substituted for the lamp voltage if such a signal is related to the lamp signal VL. For example, a coil can be inserted in the primary or secondary coil of the flyback transformer 11 to detect such a signal.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive sense.

What is claimed is:

1. A discharge lamp driving device comprising:

first means for supplying a discharge lamp with power that is higher than normal during a start-up period and with power that thereafter gradually decreases to normal power during a stabilizing period; and second means for shortening said stabilizing period when a dummy resistor having a specific resistance is connected to said first means instead of said discharge lamp.

2. A discharge lamp driving device as in claim 1 wherein:

said first means comprises a time constant circuit providing a time constant defining said stabilizing period; and said second means comprises a circuit for changing the time constant of said time constant circuit when said discharge lamp is replaced by said dummy resistor.

3. A discharge lamp driving device as in claim 2 wherein:

said time constant circuit comprises a first series circuit of a capacitor and a first resistor;

said circuit for shortening the stabilizing period comprises a second series circuit of a second resistor which has a resistance smaller than that of said first resistor and a switch member;

said second series circuit is connected in parallel with said first resistor; and said switch member connects said second resistor when power is supplied to said dummy resistor.

4. A discharge lamp driving device as in claim 2 wherein:

said second means further comprises a circuit for operating said circuit for changing the time constant when voltage applied to said dummy resistor is lower than a preset level.

5. A method of testing a discharge lamp driving circuit, said method comprising steps of:

connecting a dummy resistor load to said discharge lamp driving circuit instead of a discharge lamp;

initially supplying driving power to the connected load that is higher than normal discharge lamp operating power;

detecting a voltage applied to said dummy resistor load; and reducing said driving power to normal power when said detected voltage indicates the presence of said dummy resistor as a connected load.

6. In a discharge lamp driver having an initial turn-on mode wherein power supplied to a connected discharge lamp is initially higher than normal lamp operating power during an initial stabilizing period, the improvement comprising:

a load-type detector circuit connected to sense the presence of a substituted test load to a driver output instead of a discharge lamp; and a timing circuit connected to said detector shorter said initial stabilizing period when the presence of said substituted test load is detected.

7. A discharge lamp driver circuit comprising:

a first timing circuit connected to cause a normal-mode gradual reduction in an initially higher than normal power output to a connected discharge lamp; and a second timing circuit connected to cause a more abrupt test-mode reduction to normal power output to a connected substitute test load thereby reducing the time required to test the operability of said driver circuit.

8. A method of testing a discharge lamp driver circuit, said method comprising:

connecting a substitute test load instead of a discharge lamp to an output of the driver circuit; and reducing a normal start-up and stabilizing time used with a normal discharge lamp load thereby reducing the time required to test the operability of said driver circuit.

* * * * *